United States Patent [19]

Retrum

[11] 3,982,689

[45] Sept. 28, 1976

[54] RETURNABLE MAILING ENVELOPE

[76] Inventor: Fergus Retrum, 8708 - 14th Ave. South, Bloomington, Minn. 55420

[22] Filed: July 14, 1975

[21] Appl. No.: 595,571

[52] U.S. Cl. ..... 229/71; 229/73; 229/85

[51] Int. Cl.[2] ..... B65D 27/04; B65D 27/06; B65D 27/34

[58] Field of Search ..... 229/71, 73, 85

[56] References Cited

UNITED STATES PATENTS

| | | | |
|---|---|---|---|
| 1,373,512 | 4/1921 | Kuhhorn | 229/73 |
| 2,310,371 | 2/1943 | Lines et al. | 229/85 |
| 2,941,711 | 6/1960 | Biek | 229/73 |
| 3,062,431 | 11/1962 | Rabenold | 229/73 |
| 3,152,751 | 10/1964 | Hiersteiner | 229/73 |
| 3,221,980 | 12/1965 | Mercur | 229/71 |
| 3,498,528 | 3/1970 | Klein | 229/73 |
| 3,523,638 | 8/1970 | Moonan | 229/92.1 |
| 3,733,025 | 5/1973 | Hiersteiner | 229/85 |

FOREIGN PATENTS OR APPLICATIONS

| | | | |
|---|---|---|---|
| 401,946 | 8/1909 | France | 229/85 |
| 510,989 | 8/1939 | United Kingdom | 229/85 |

*Primary Examiner*—Stephen P. Garbe
*Attorney, Agent, or Firm*—Merchant, Gould, Smith, Edell, Welter & Schmidt

[57] ABSTRACT

A mailer comprising a window envelope and an enclosure to be transmitted therein. The envelope is provided with first and second tear strips which are adhesively joined when the envelope is first sealed, but which can be torn off as a unit to leave a reusable envelope. The enclosure is provided with a first removable portion to be retained by the recipient, and a second portion to be returned to the sender. It also includes two address areas laterally positioned to line up with the window of the envelope. As mailed, a first address area is in the window and the enclosure fills the envelope. Tearing off the removable portion of the enclosure reduces its size to fit the modified envelope, and the second area lines up with the envelope window. A modification of the invention forms a pulltab for convenience in opening the original envelope.

4 Claims, 9 Drawing Figures

RETURNABLE MAILING ENVELOPE

BACKGROUND OF THE INVENTION

This invention relates to the field of written communications, and particularly to a combination envelope and enclosure adapted for two-way mailing use. A typical use for my invention is in the sending out of monthly statements by business firms. It is very desirable that the customer return a portion of his statement with his remittance, to facilitate proper crediting of payments in the books of the firm, and it has been found desirable to enclose a return envelope addressed to the firm to expedite payment. Numerous attempts have been made to combine the statement, its envelope, and the return envelope in ways readily understandable and usable by the customer, which will optimize the process of sending statements and returning payments for both the firm and the customer.

SUMMARY OF THE INVENTION

I have invented the new mailer combination of an envelope with an enclosure which has advantages and features of novelty due in part to novelty of the envelope and the enclosure themselves. In my arrangement a window envelope is used for transmittal to the customer and modified by the customer to return his payment: the enclosure sent to the customer has a separable portion for return with the customer's remittance in the modified envelope, while he keeps the remaining portion for his own records. No addressing of the envelope is required either by the mailing firm or the customer. In opening the envelope, the customer prepares it for reuse, and in removing a detailed statement portion from the enclosure, he prepares the latter to accompany his remittance. The customer need only affix a stamp and his address, place his remittance in the envelope and insert the return part of the enclosure between the remittance and the window so that the address of the firm is visible through the window.

This arrangement performs the several functions of providing a detailed statement of the customer's account which he may keep, providing him with a return envelope for his remittance, optimizing the likelihood that the remittance may readily be credited to the proper customer, requiring no addressing of the envelope either by the firm or the customer, other than affixing of the customer's return address, and tending to make all of the remittances received of uniform size to fit the firm's letter opening equipment with a minimum damage to contents.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

DESCRIPTION OF THE PREFERRED EMBODIMENTS

Figure 5:
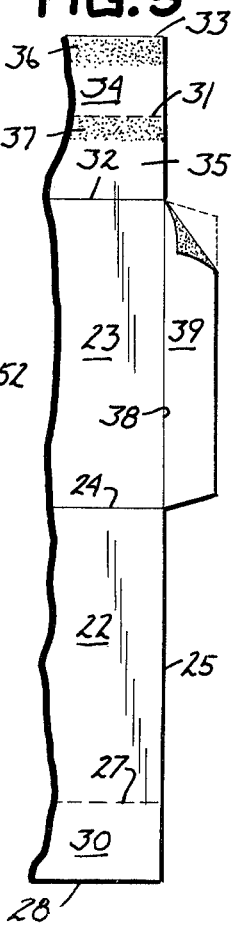
FIG. 5 is a fragmentary development of the envelope of FIG. 1.

My mailer is shown to comprise an envelope 20 and an enclosure 21. Envelope 20 is made up of a front panel 22 and a back panel 23 which may be connected along a common bottom edge 24 by suitable joining means such as an adhesive, or may be portions of the same sheet of paper, as shown in FIG. 5.

Figure 1:
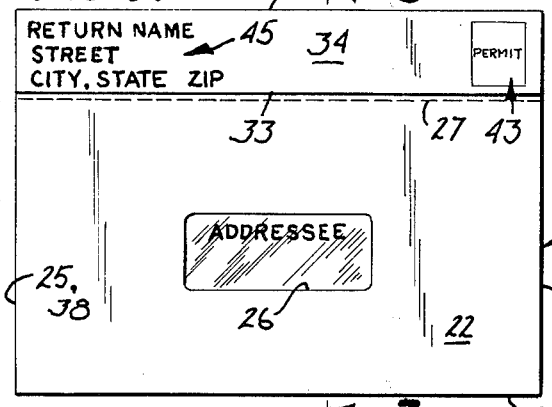
FIG. 1 is a face view of a mailer according to my invention as ready for initial mailing.
Figure 2:
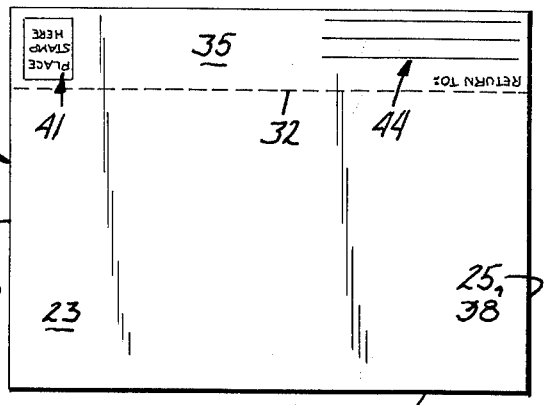
FIG. 2 is a rear view of FIG. 1.
Figure 6:
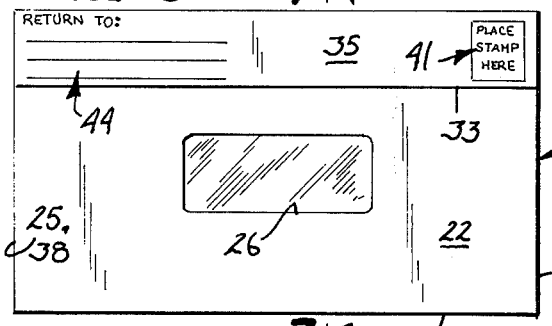
FIG. 6 is a view similar to FIG. 1 showing the mailer ready to be returned by the customer.
Figure 3:
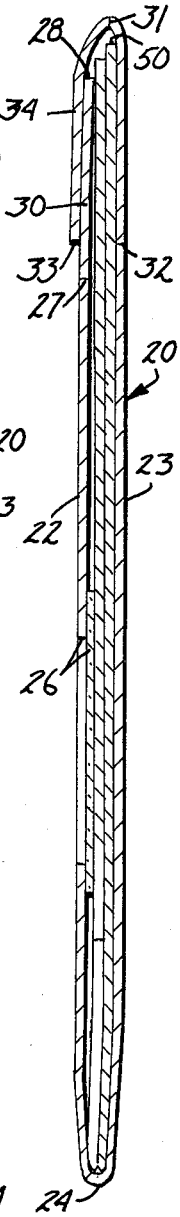
FIG. 3 is a section along the line 3—3 of FIG. 1 to a larger scale.
Figure 7:
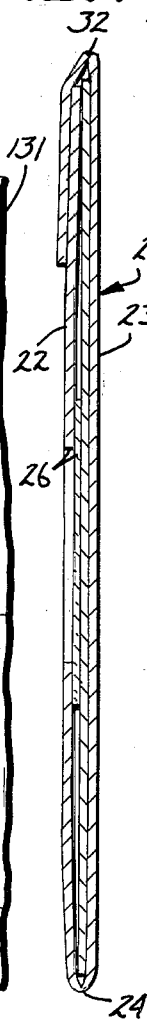
FIG. 7 is a section taken along the line 7—7 of FIG. 6.
Figure 4:
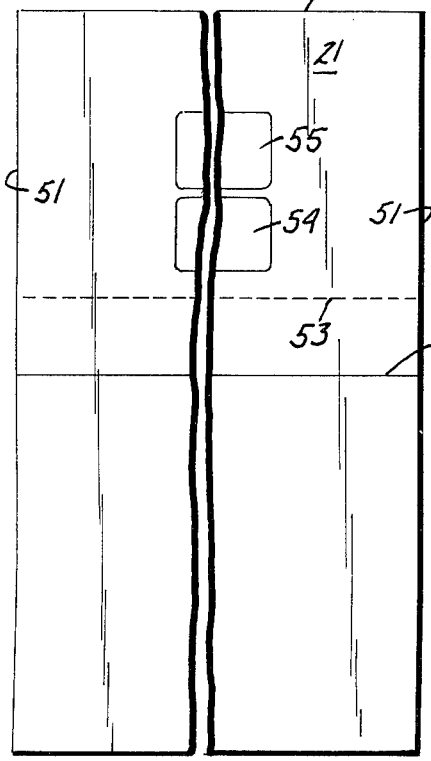
FIG. 4 is a development view of the enclosure of FIG. 1.

Panel 22 has side edges 25 and a window 26, and a tear line 27, for example a line of perforations, extends along the panel at a location below its top edge 28 to define a first tear strip 30. Note that the bottom of the envelope is defined at 24 in FIGS. 1, 2, and 3, so that in development view FIG. 5 parts 27, 28, and 30 appear "below" the bottom edge 24.

Panel 23 has a fold-and-tear line 31 and a fold line 32 spaced from its top edge 33 to define a first flap 34 and a second flap 35 of approximately equal width. Lines of adhesive 36 and 37 are applied to the panel below top edge 33 and fold-and-tear line 31 respectively, on the face of panel 23 which is toward panel 22 in the completed envelope. The side edges 38 of panel 23 may be connected adhesively to side edges 25 of panel 22, or the connection may be made by gummed flaps 39 extending from bottom edge 24 to fold line 32, or, of course, by similar flaps on panel 22.

On the opposite face of flap 35 is provided at 44 an area for the customer to apply his return address, and at 41 an indicated location for the customer's postage stamp, and on the face of flap 34 are imprinted at 45 the firm's return address, and at 43 its postage metering permit.

Enclosure 21 has a top edge 50, side edges 51 and a bottom edge 52: when a relatively large area may be needed, bottom edge 52 may in fact be a fold line as shown in the figure. A tear line 53 extends across enclosure 21 above the bottom edge 52. Positioned on enclosure 21 in lateral alignment with the position of window 26 of envelope 20 are first and second address areas 54 and 55. The space between edge 52 and line 53 is equal to the width of strip 30 and that of flap 34, while the distance from edge 50 to edge 52 of the enclosure is substantially equal to the width of envelope panel 23 from bottom edge 24 of envelope 22 to fold-and-tear line 31. The distance from bottom edge 52 to address area 54 is the same as that between the bottom edge 24 of envelope panel 22 and window 26, as is the distance from tear line 53 to address area 55.

In use the firm prints its own address in area 45, the customer's address in area 54, and the matter to be communicated, such as the items in an account for a specified time, in the space below tear line 53. Enclosure 21 is then folded on line 52, if necessary, addresses 55 and 54 being on the outside of the fold. The enclosure is placed in the envelope with area 54 in line with window 26, and first flap 34 is folded over and adhered to the outside of tear strip 30. The mailer is now stamped or metered if necessary, and can then be deposited in the outgoing mail.

When a customer receives the mailer he tears the envelope along lines 27 and 31, removing both strip 30 and strip 34 without attempting to release the adhesive connection between them. Enclosure 21 is now removable from the envelope, so the customer can inspect his statement and prepare an appropriate check. When he is ready to make his remittance he tears the enclosure along line 53, retaining the portion below the line for his records, and inserts the remainder of the enclosure into the envelope with the address area 55 facing window 26. Placing his check behind the enclosure, he turns flap 35 over on fold line 32 and then adheres it to the envelope. After affixing his address at 44 and the stamp at 41, he may remail this mailer to the issuing firm.

Figure 8:
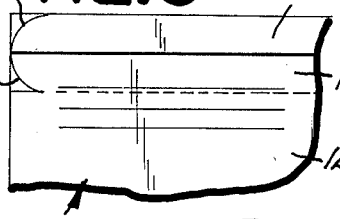
FIG. 8 is a fragmentay view of a modification of the invention.
Figure 9:
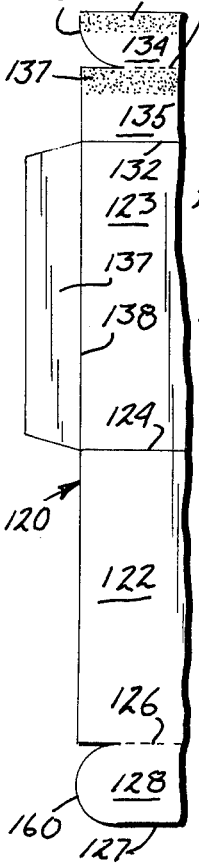
FIG. 9 is a view like FIG. 5 but of the envelope of the modification.

A slight modification of the invention is shown in FIGS. 8 and 9. In these figures, the parts related to the parts in the earlier figures are given the same reference numerals increased by 100. The enclosure for this modification is unchanged. The ends of strip 128 are cut semicircularly at 160, strip 134 is reduced in width, and the ends of strip 134 are cut along circular arcs 161. The arcuate ends 160 and 161 when adhered together form a convenient pulltab by which the customer may open the mailer upon receipt thereof.

From the foregoing, it will be evident that I have invented a new and useful two-way mailer having features of added convenience both for the initial sender and for the recipient as well. The component envelope and enclosure are also novel and have features which combine to give the mailer its increased usefulness. The envelope can be preprinted in bulk and never requires anything to be added by the firm: all recording, addressing, and so on is done solely on the enclosure, making for reduced costs in accounting procedures. The envelope is easily opened by the recipient, and the act of opening it prepares it for use as a return envelope, to which the customer need only add a stamp and his return address. The portion of the enclosure significant to the customer remains in his possession, and the portion of use to the concern is employed by the customer to address the letter and hence returns for accounting use.

Numerous characteristics and advantageous of my invention have been set forth in the foregoing description, together with details of the structure and function of the invention, and the novel features thereof are pointed out in the appended claims. The disclosure, however, is illustrative only, and changes may be made in detail especially in matters of shape, size, and arrangement of parts, within the principle of the invention, to the full extent indicated by the broad general meaning of the terms in which the appended claims are expressed.

What is claimed is:

1. In combination:

an envelope for two-way use and an enclosure for transmittal therein;

said envelope having a front panel with a transparent window spaced above a bottom edge thereof, and said enclosure having (a) a bottom edge, (b) a tear line spaced above said bottom edge by less than the spacing of said window above the bottom edge of said panel (c) a first address area spaced above said bottom edge of said enclosure by the spacing of said window above the bottom of said panel and (d) a second address area spaced above said tear line by the spacing of said window above the bottom edge of said panel.

2. An enclosure, for two-way mailing use, having top, side, and bottom edges, a tear line spaced from said bottom edge, a first delimited address area spaced above said bottom edge by a distance no less than the spacing of said tear line therefrom, and a second delimited address area spaced above the tear line by a distance equal to the spacing of the first address area from the bottom edge.

3. The structure of claim 1 in which said bottom edge of said enclosure comprises a fold line of a longer sheet.

4. An envelope having a flap securable to a back along an adhesive sealing closure, and having spaced tear lines along said flap and said back, aligned with said closure, along which the envelope may be opened after sealing, without unsealing the normal adhesive closure thereof, to comprise a usable envelope narrower than the original envelope and an enclosure having an initial dimension to fit the envelope in its original condition, and a tear line facilitating separation of a return portion dimensioned to fit the envelope as used after opening.

* * * * *